US008209113B2

(12) United States Patent
Zerod

(10) Patent No.: US 8,209,113 B2
(45) **Date of Patent: *Jun. 26, 2012**

(54) PROGRAMMABLE ROUTE SPECIFIC DYNAMIC TRAFFIC WARNING SYSTEM WITH SEGMENTATION IDENTIFIERS

(75) Inventor: Richard D. Zerod, Chelsea, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 1101 days.

This patent is subject to a terminal disclaimer.

(21) Appl. No.: 12/106,419

(22) Filed: Apr. 21, 2008

(65) Prior Publication Data

US 2008/0201065 A1 Aug. 21, 2008

Related U.S. Application Data

(63) Continuation-in-part of application No. 11/580,168, filed on Oct. 12, 2006, now Pat. No. 7,617,045.

(51) Int. Cl.
*G06G 1/00* (2006.01)

(52) U.S. Cl. ..... 701/117

(58) Field of Classification Search ..... 701/117–119, 701/200–201, 210; 340/998, 995.13
See application file for complete search history.

(56) References Cited

U.S. PATENT DOCUMENTS

| | | | | |
|---|---|---|---|---|
| 5,369,588 | A | 11/1994 | Hayami et al. | |
| 6,154,703 | A | 11/2000 | Nakai et al. | |
| 6,192,315 | B1 | 2/2001 | Geschke et al. | |
| 6,484,093 | B1 | 11/2002 | Ito et al. | |
| 6,700,482 | B2 | 3/2004 | Ververs et al. | |
| 6,850,842 | B2 | 2/2005 | Park | |
| 6,870,478 | B2 | 3/2005 | Yasushi et al. | |
| 7,065,445 | B2 | 6/2006 | Thayer et al. | |
| 7,084,767 | B2 | 8/2006 | Hasegawa et al. | |
| 7,194,355 | B2 | 3/2007 | Omi | |
| 7,617,045 | B2 * | 11/2009 | Zerod et al. | 701/210 |
| 2005/0288836 | A1 | 12/2005 | Glass et al. | |
| 2007/0225907 | A1 | 9/2007 | Oonishi et al. | |
| 2007/0276596 | A1 | 11/2007 | Solomon et al. | |
| 2011/0015853 | A1 * | 1/2011 | DeKock et al. | 701/200 |

OTHER PUBLICATIONS

International Standard ISO 14819-1 European Traffic and Traveller Information, Section 5.3.4.3; ISO 2003.

* cited by examiner

*Primary Examiner* — Kim T Nguyen
(74) *Attorney, Agent, or Firm* — Fraser Clemens Martin & Miller LLC; J. Douglas Miller

(57) ABSTRACT

A method for selectively providing traffic information to a user without requiring the user to constantly monitor radio broadcasts is disclosed. The method comprises the steps of: determining at least one area of interest including a plurality of latitudinal and longitudinal coordinates; receiving traffic data including information related to a plurality of traffic events; parsing the traffic data for any of the traffic events located within at least one area of interest; and outputting a traffic event message to an output device if the latitudinal and longitudinal location of the related traffic event is located within the at least one area of interest.

20 Claims, 4 Drawing Sheets

PROGRAMMABLE ROUTE SPECIFIC DYNAMIC TRAFFIC WARNING SYSTEM WITH SEGMENTATION IDENTIFIERS

CROSS-REFERENCE TO RELATED APPLICATION

The present U.S. Utility Patent Application claims priority pursuant to 35 U.S.C. §120, as a continuation-in-part (CIP), to the U.S. Utility patent application Ser. No. 11/580,168 filed on Oct. 12, 2006, which is hereby incorporated herein by reference in its entirety and made part of the present U.S. Utility Patent Application for all purposes.

FIELD OF THE INVENTION

The present invention generally relates to systems and methods for providing automobile traffic information to a user of an automobile.

BACKGROUND OF THE INVENTION

The number of automobiles found on roads has increased remarkably. Because of this increase and the difficulty and expense of providing additional roads to accommodate the increase of automobiles, the amount of automobile traffic has substantially increased. In order to avoid traffic congestion, drivers of automobiles have been provided traffic information in numerous ways. The most common way of providing traffic information to drivers is via audio broadcasts on AM/FM radio stations. Typically, radio stations broadcasting traffic information do so at designated intervals. For example, some radio stations may provide traffic information every fifteen minutes. Between the traffic information broadcasts, the radio station provides its standard programming. Other methods for receiving traffic information are available over the Satellite Digital Audio Radio Service (SDARS). Both XM and Sirius Satellite Radio have dedicated audio channels which provide traffic information for numerous major cities.

Although cost effective and simple to operate, each of these methods has several significant drawbacks. For AM/FM broadcasts, one drawback is that the driver must wait for the traffic information to be broadcasted. Because of this wait, the driver may not have sufficient advance notice to be able to adjust his/her route to avoid traffic. Another drawback is that the driver must continually monitor the radio station for the traffic information. If the driver changes radio stations or utilizes another audio based entertainment device, such as a compact disk player, the driver risks not receiving the traffic information. A further drawback is that the traffic information may not be relevant to the area in which the driver is traveling. Although the SDARS service providers offer dedicated traffic channels for select markets, similar drawbacks exist in that the driver must periodically re-tune to the same channel in order to obtain the latest traffic information, and the traffic information may not be relevant to the area in which the driver is traveling.

Another way of providing traffic information to the driver is via a vehicle navigation system. A vehicle navigation system may be configured to receive traffic information on the data channel from AM, FM, or satellite digital audio radio services, such as the XM and Sirius satellite radio services. Because the vehicle navigation system will automatically monitor incoming data for relevant traffic information, there is no need for the driver to constantly monitor a radio broadcast. However, vehicle navigation systems are costly and are complex to operate, preventing many drivers from considering this option.

It would be desirable to have a method for selectively providing traffic information to a user without requiring the user to constantly monitor radio broadcasts.

SUMMARY OF THE INVENTION

Concordant and consistent with the present invention, a method for selectively providing traffic information to a user without requiring the user to constantly monitor radio broadcasts, has surprisingly been discovered.

In one embodiment, a computer readable storage medium has stored therein data representing instructions executable by a programmed processor for enabling operation of a system for providing a user with traffic information, and the storage medium comprises instructions for: determining at least one area of interest including a plurality of latitudinal and longitudinal coordinates; receiving traffic data including information related to a plurality of traffic events; parsing the traffic data for any of the traffic events located within the at least one area of interest; determining a priority level of each of the traffic events within the at least one area of interest; comparing the priority level of each of the traffic events within the at least one area of interest with a user-selected priority level; filtering the traffic events to remove any traffic event that does not meet the user-selected priority level; and outputting a traffic event message to an output device if the latitudinal and longitudinal location of the related traffic event is located within the at least one area of interest.

The invention also provides methods for providing traffic information to a user.

One method comprises the steps of: determining at least one area of interest including a plurality of latitudinal and longitudinal coordinates; receiving a traffic data including information related to a plurality of traffic events; parsing the traffic data for any of the traffic events located within at least one area of interest; and outputting a traffic event message to an output device if the latitudinal and longitudinal location of the related traffic event is located within at least one area of interest.

Another method comprises the steps of: determining at least one area of interest including a plurality of latitudinal and longitudinal coordinates; receiving a traffic data including information related to a plurality of traffic events; parsing the traffic data for any of the traffic events located within the at least one area of interest; determining a priority level of each of the traffic events within the at least one area of interest; comparing the priority level of each of the traffic events within the at least one area of interest with a user-selected priority level; filtering the traffic events to remove any traffic event that does not meet the user-selected priority level; and outputting a traffic event message to an output device if the latitudinal and longitudinal location of the related traffic event is located within the at least one area of interest.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
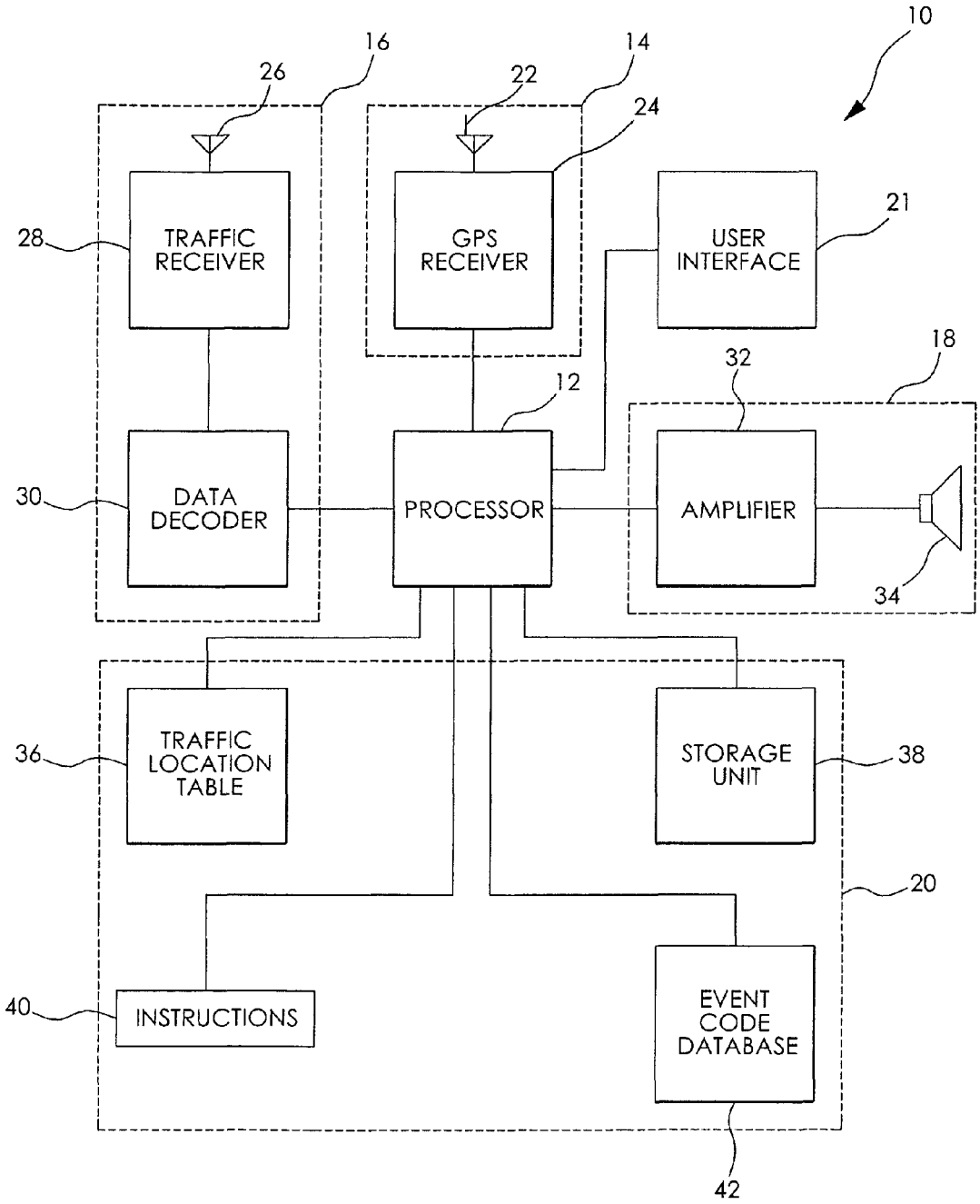
FIG. 1 is a schematic block diagram of a system for providing a user with traffic information embodying the principles of the present invention.

Referring to FIG. 1, a system embodying the principles of the present invention is illustrated therein and designated at 10. The system 10 includes a processor 12 in communication with an automobile location system 14, a traffic messaging system 16, an output system 18, a storage system 20, and a user interface 21. As it is well known in the art, the processor 12 may be a "system on a chip" integrating one or more of the automobile location system 14, traffic messaging system 16, output system 18, and storage system 20.

The automobile location system 14 is a global positioning system ("GPS") based system. The automobile location system 14 thus has a GPS antenna 22 capable of receiving GPS signals and communicating those signals to a GPS receiver 24. The received signals are generated by a plurality of GPS satellites and the automobile location system 14 is able to determine the position of the system 10, and therefore the automobile, by triangulating the received GPS signals. During operation of the system 10, the GPS receiver 24 may continually or intermittently provide the location of the system 10 to the processor 12.

The traffic messaging system 16 includes a traffic messaging antenna 26 in communication with a traffic receiver 28. Generally, the traffic messaging antenna 26 will receive signals containing automobile traffic data, such as location of traffic events and traffic event type. (Traffic event type identifies the cause of the traffic, such as an accident, immobilized vehicle, and road construction.) These automobile traffic signals may be generated as a sub-carrier from traditional AM and FM stations, generated from a High Definition (HD) Radio station, or may be generated from satellite digital audio radio services such as XM and Sirius.

Specifically, the traffic messaging system 16 is adapted to receive traffic signals coded in accordance with the Alert-C protocol such as RDS-TMC messages, for example. Typically, RDS-TMC messages provide the following broadcast information: an Event Description data including details of the weather situation or traffic problem (e.g. congestion caused by accident) and, where appropriate, its severity (e.g. resulting queue length); a Location data indicating the area, road segment or point location where the source of the problem is situated; a Direction and Extent data identifying the adjacent segments or point locations also affected by the event, and where appropriate the direction of traffic affected; a Duration data including an estimation of how long the problem is expected to last; and a Diversion Advice data showing whether or not end-users are recommended to find and follow an alternative route. Other information may be included, as desired. Specifically, an Alert-C traffic signal may contain information regarding the number of adjacent road segments that are affected by a particular traffic incident. It is understood that the information regarding the number of adjacent road segments that are affected by a particular traffic incident is defined in ISO14819-1, section 5.3.4.3 and is referred to as the "Extent" bits. Since the system 10 does not contain a map database, it is not possible to visually convey this information to the user. However, by decoding the number of adjacent road segments from the Alert-C traffic signal and using a location table to retrieve the specific road segments, an audible description of a traffic back-up can be provided to the user using a text-to-speech system. It is understood that the traffic back-up information can be conveyed in either absolute or relative terms.

The traffic receiver 28 provides the incoming traffic signals to a data decoder 30 that processes the received traffic signals and provides the traffic data to the processor 12. The data decoder 30 will generally arrange the data received from the traffic receiver 28 in a manner that the processor 12 can process and may, among other things, decrypt the data received from the traffic receiver 28. As will be appreciated by those skilled in the field of this technology, the data decoder 30 may be comprised of a combination of hardware and software where certain instructions may be executed by the processor 12. It is understood that the processor 12 may be adapted to convert the decoded traffic signal using text-to-speech processing. It is further understood that the processor 12 may be adapted to convert the decoded traffic signal using phoneme-to-speech processing.

The output system 18 is generally an audio output system. Alternatively or additionally, output system 18 may include a display device. In the output system 18, any audio signals transmitted from the processor 12 are received by an amplifier 32. The amplifier 32 amplifies the audio signals, which detail traffic information relevant to the area of interest, and outputs the signal to the speaker 34, the output of which is heard by the occupant(s) of the automobile. The output system 18 may optionally be shared with other audio systems in the automobile, such as the AM/FM radio receiver or CD player. In this case, the audio signals transmitted from the processor 12 would temporarily interrupt and take precedence over the other optional audio sources and transmit the traffic information to the occupant(s) of the automobile. After transmission of the traffic information had been completed, the output system 18 could be utilized again by the optional audio sources. If the system 10 includes a display device, video or control signals from the processor 12 are displayed thereon for viewing by the occupant(s) of the automobile.

The storage device 20 includes a traffic location table 36, a storage unit 38, an instruction set 40, and an event code database 42. As will be appreciated by those skilled in the field of this technology, the storage system 20 may be a single storage device or may be multiple storage devices. Portions of storage system 20 may also be located on processor 12. Furthermore, the storage system 20 may be a solid state storage system, a magnetic storage system, an optical storage system or any other suitable storage system.

The traffic location table 36 contains a table having latitudinal and longitudinal coordinates corresponding to a variety of different road locations. As it is well known, map database and traffic location table manufacturers, such as the Navteq Corporation of Chicago, Ill., refer to road points using a customized numbering system. The traffic location table 36 contains latitudinal and longitudinal coordinates corresponding to these road points. The instruction set 40, which may be embodied within any computer readable medium, includes processor executable instructions for configuring the processor 12 to perform a variety of tasks, as will be later explained in connection with FIGS. 2, 3 and 4. The event code database 42 contains a description of the traffic event corresponding to the traffic event code. Finally, the storage unit 38 is a temporary storage unit that allows the processor 12 to temporarily store and retrieve data when required by the processor 12.

The user interface 21 is in data communication with processor 12. It is understood that the user interface 21 may be any conventional interface that provides control of a desired function of the processor 12 based on user-generated input, such as an interactive touch-screen, for example. Other interfaces may be used, as desired. The user may engage the user interface 21 to pre-program the processor to define which traffic event information is transmitted to the user. Pre-programming may be based on various traffic event characteristics such as the level of severity, for example. Specifically, a traffic accident that closes down a freeway has a higher level of severity than routine construction that has been on-going for several months. In one embodiment, each traffic message is categorized into one of three priority levels based on urgency and duration of the traffic event. Specifically, the urgency and duration is decoded from the Alert-C traffic signal and the traffic data of each traffic signal is categorized as one of low priority, normal priority, and high priority. As a non-limiting example, each traffic event code may be assigned a priority level within the event code database. Accordingly, only a traffic event categorized in a user-selected priority level is transmitted to the user. For example, the user may select that only the traffic events categorized as high priority be transmitted to the user and all other traffic events decoded from the Alert-C traffic signal are filtered out. It is understood that other methods of categorization may be used, as desired. It is further understood that any number of categories may be used, as desired.

Figure 2:
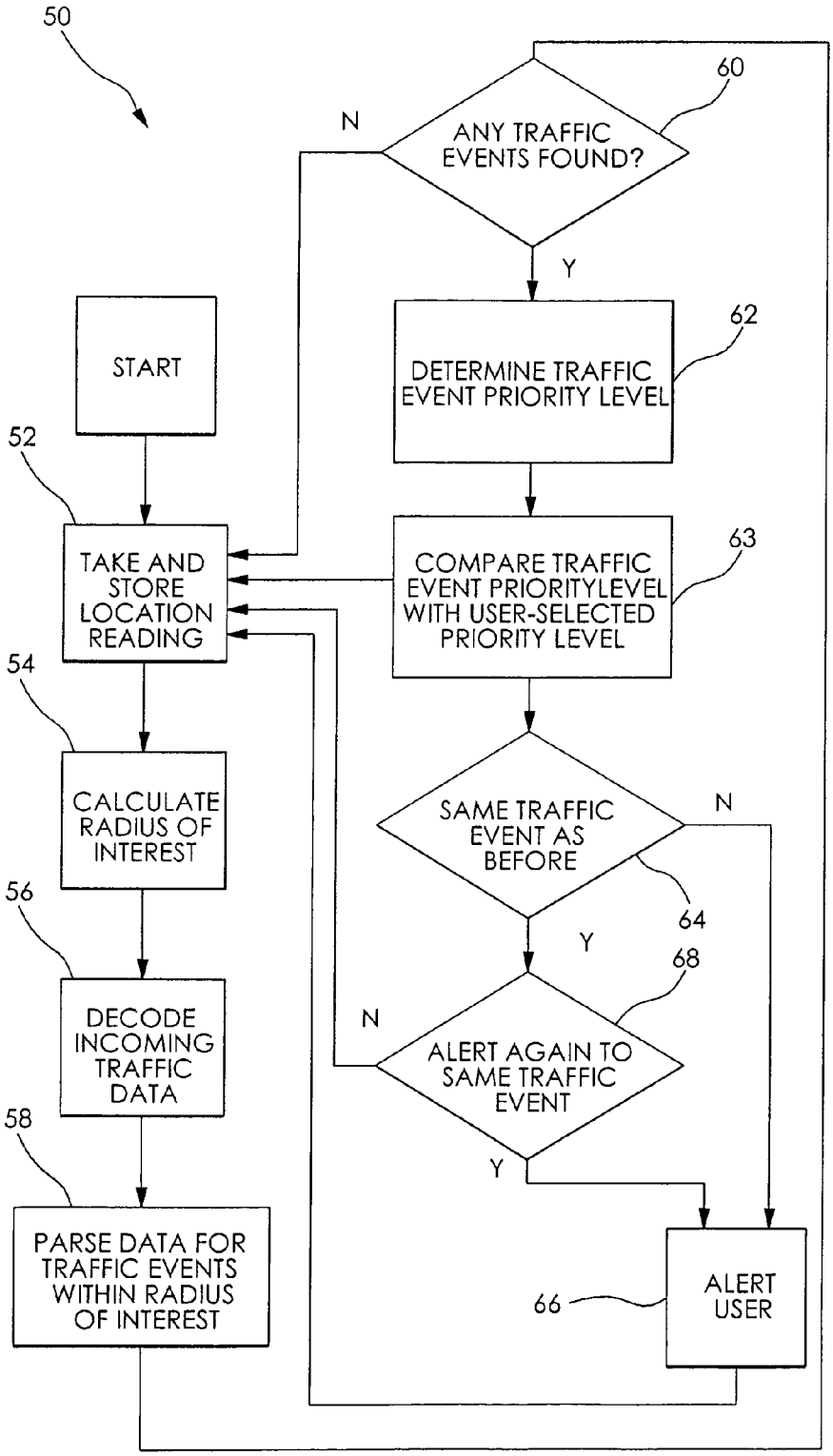
FIG. 2 is a flow chart of a method for providing a user with traffic information according to an embodiment of the present invention.

Referring to both FIGS. 1 and 2, a method 50 for providing traffic messaging information according to one aspect of the invention will now be described. The method 50 is embodied in the instruction set 40 that is executed by the processor 12. In step 52, the automobile location system 14 takes a location reading. This location reading is indicative of the location of the system 10 (and thus the automobile) and is stored within the storage unit 38. In step 54, the processor 12 calculates an area or radius of interest as determined from an input provided by the user through the user interface 21. The area of interest corresponds to an area within a defined radius surrounding the location reading. This radius of interest will therefore include a plurality of latitudinal and longitudinal coordinates surrounding the location reading. The user will have the ability to select from at least two different radius settings which will contain differing amounts of latitudinal and longitudinal coordinates.

In step 56, the traffic messaging system 16 receives and decodes incoming traffic data. Thereafter, in step 58, the processor 12 parses the incoming traffic data for any traffic events located within the area of interest as well as any adjacent road segments located within the area of interest that are affected by the traffic event. Simultaneously, the processor 12 parses the incoming traffic data for any affected road segments located within the area of interest that are affected by a traffic event that is located outside the area of interest. In order to accomplish this task, the processor 12 must convert the incoming traffic data to latitudinal and longitudinal coordinates. This is done by taking the incoming traffic data and looking up corresponding road segments in the traffic location table 36.

In step 60, the processor 12 determines if any traffic events are located within the selected area of interest. The traffic events include any traffic incidents located within the area of interest as well as any adjacent road segments located within the area of interest that are affected by the traffic incident and any affected road segments located within the area of interest that are affected by a traffic incident that is located outside the area of interest. If no traffic event is located within the selected area of interest, the method 50 returns to step 52. Otherwise, the method 50 proceeds to step 62.

In step 62, the processor 12 determines a priority level of the traffic event. The priority level of the traffic event is compared with a user-selected priority level, as shown in step 63. If the traffic event priority level is below the user-selected priority level, the method 50 returns to step 52. Otherwise, the method 50 proceeds to step 64.

In step 64, the processor 12 determines if the traffic event has not been discovered before. If the traffic event is new and has not been identified in a prior cycle of the method 50, the user is alerted via the output system 18, as shown in step 66. This can be accomplished by converting the traffic event into audible speech using a text to speech engine. This audible traffic message alert may include a traffic event location, information regarding affected road segments, and a traffic event type, for example. It is understood that the audible alert may be conveyed in either absolute or relative terms. As a non-limiting example, an audible alert to the user may be: "Accident on westbound I-94 at I-275. Traffic is backed up to Merriman Road." Alternatively, the same traffic event may be presented as: "Accident on westbound I-94 at I-275. Traffic is backed up approximately 3 miles".

If the same traffic event was reported before, the processor 12 determines if the user should be alerted again, as shown in step 68. The processor 12 makes this determination based on an input provided by the user through the user interface 21. If the traffic event was reported to the user recently, the processor 12 will report the same traffic event again if requested by the user. One method of accomplishing this would be by pushing a button on the user interface 21. Alternatively, the processor 12 can report a plurality of previously reported traffic events to the user. If there is no request by the user, the processor 12 will not report the traffic event again to the user, wherein the method 50 returns to step 52. Otherwise, the processor 12 will alert the user again via the output system 18, as shown in step 66.

Figure 3:
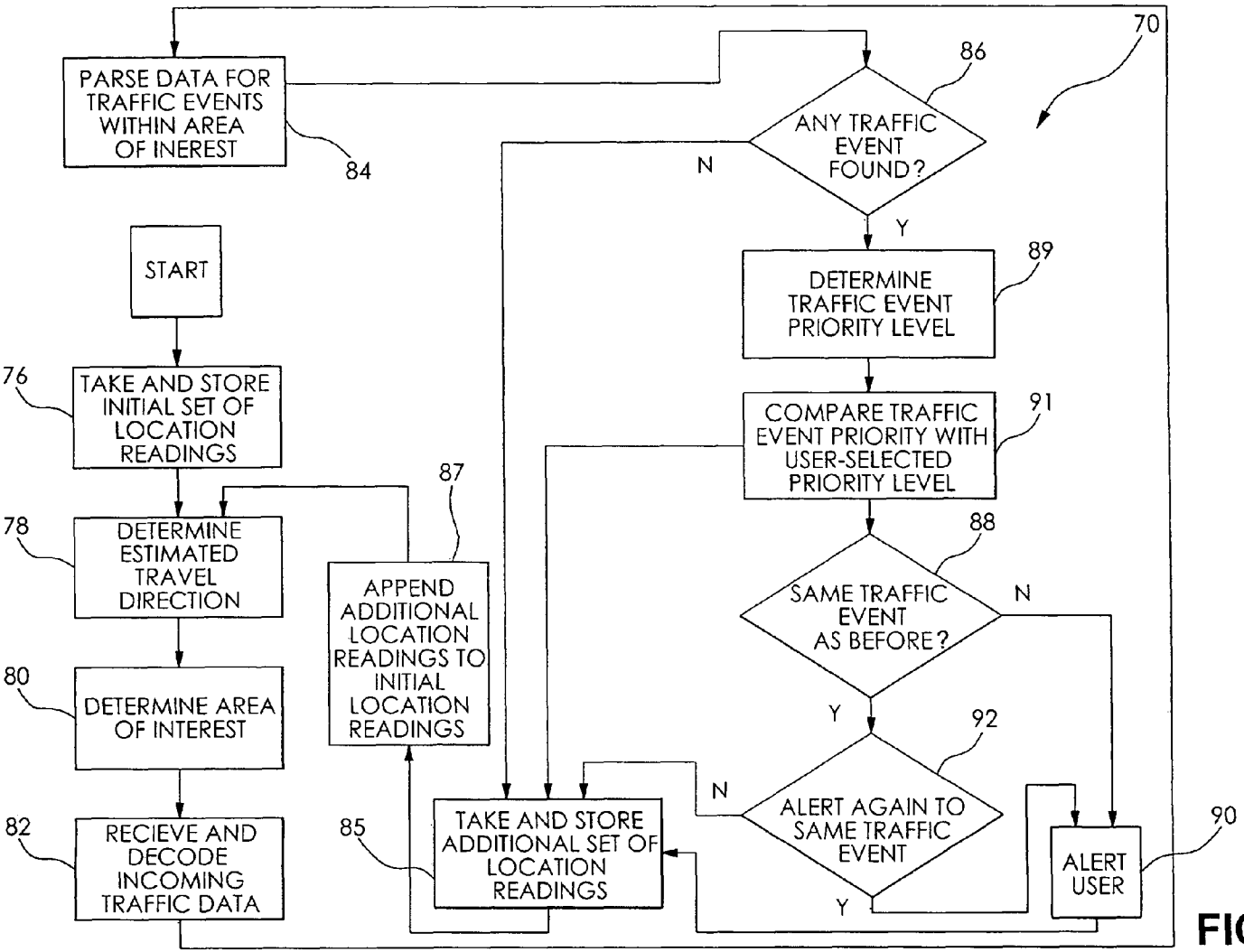
FIG. 3 is a flow chart of a method for providing a user with traffic information according to another embodiment of the present invention.

Referring to FIGS. 1 and 3, another method 70 for providing traffic information to a user is shown. In step 76, the automobile location system 14 takes and stores an initial set of location readings which are stored in the memory unit 38. The initial set of location readings are taken at periodic intervals with an associated wait state between each reading. The processor 12, in step 78, determines an estimated travel direction by comparing the latitudinal and longitudinal changes among the set of readings, Since step 76 allowed for a wait state between individual location readings, the automobile has been provided with some travel time and a general direction of the automobile can be determined.

In step 80, the processor 12 determines an area of interest. This area of interest includes a plurality of coordinates surrounding the travel direction by a predetermined angle and radius. The user will have the ability to select from at least two different radius settings through the user interface 21 which will contain differing amounts of latitudinal and longitudinal coordinates. The specific radius can be absolute values, for example ten miles, or it can be dynamically determined by processor 12 based on the speed of the automobile. Similarly, the angular setting can be a predetermined fixed amount, or it can be dynamically determined by processor 12 based on the latitudinal and longitudinal changes occurring among the set of location readings.

In step 82, the traffic messaging system 16 receives and decodes incoming traffic data. Thereafter, in step 84, the processor 12 parses the incoming traffic data for any traffic events located within the previously determined area of interest. The traffic events may include any traffic incidents located within the area of interest as well as any adjacent road segments located within the area of interest that are affected by the traffic incident and any affected road segments located within the area of interest that are affected by a traffic incident that is located outside the area of interest.

As shown in step 86, if no traffic events are found, the method 70 proceeds to step 85 where an additional set of location readings are taken at periodic intervals with an associated wait state between each reading. These readings are stored in the memory unit 38. Thereafter, in step 87, the additional location readings are appended to the initial set of location readings to provide a larger statistical set of location data which can be utilized by processor 12, in step 78, to more accurately determine an estimated travel direction. By storing the additional location data, a new travel direction can be determined in the event the actual travel direction has changed.

If any traffic event is found, the method 70 proceeds to step 89. In step 89, the processor 12 determines a priority level of the traffic event. The priority level of the traffic event is compared with a user-selected priority level, as shown in step 91. If the traffic event priority level is below the user-selected priority level, the method 70 proceeds to step 85. Otherwise, the system 10 determines if the same traffic event was reported in a prior cycle of the method 70, as shown in step 88.

If the same traffic event was not reported before, the user is alerted as indicated in step 90. Otherwise, the system 10 determines if the user should be alerted again. This determination is similar to step 66 in FIG. 2. After step 92 and/or 90 have been executed, the system proceeds to previously described step 85.

Figure 4:
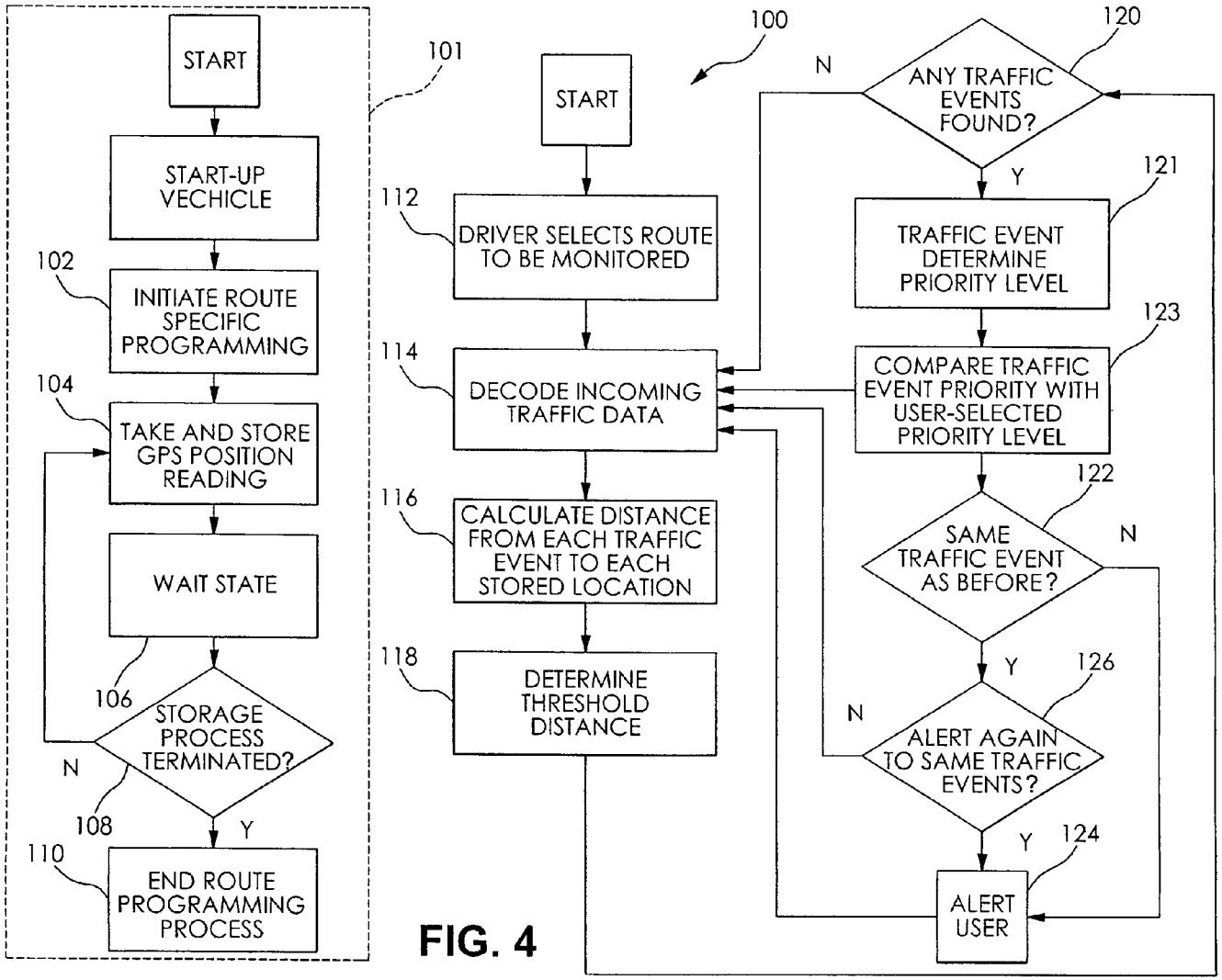
FIG. 4 is a flow chart of a method for providing a user with traffic information according to another embodiment of the present invention.

Referring to FIGS. 1 and 4, an alternative method 100 for providing traffic information to a user is shown. As a brief overview, methods 100 and 101 provide the user with traffic information for traffic events along a commonly traveled route. To be more specific, the method 100 includes a subroutine 101 that records the commonly traveled route. The main method 100 provides the user with traffic event information along the commonly traveled route. As such, the subroutine 101 is performed prior to method 100. The method 100 may be performed immediately or any subsequent time after method 101.

In step 102 of the subroutine 101, the processor 12 initiates a specific route programming to record the commonly traveled route. This may be initiated by the user or by the processor 12 itself. It should be understood that multiple common routes may be recorded and stored. For example, these multiple common routes may include routes to multiple work locations as well as often traveled entertainment locations.

In step 104, the processor 12 takes and stores from the automobile location system 14 a location reading. In step 106, the processor 12 waits. Thereafter, in step 108, it is determined if additional reading are required or if the storage process can be terminated, and if the storage process is to be terminated, the commonly traveled route programming process is terminated as shown in step 110. Otherwise, the method 101 returns to step 104 and continually stores the locations of the automobile. By storing a set of multiple location readings, the processor can define a specific route. The user will have the ability to store at least two different sets of differing location readings, each of which will define a specific route.

In step 112, the user selects a specific pre-recorded route on which to receive traffic information. The user will have the ability to selecting from at least two different route settings through the user interface 21. In step 114, the processor 12 decodes the data received from the traffic messaging system 16 for traffic events in the geographic region containing the selected route. It is understood that the processor 12 may determine an estimated travel direction by comparing the latitudinal and longitudinal changes among the set of location readings. For example, processor 12 can decode all the traffic messages for the market which contains a portion of the selected route that is ahead of the traveling vehicle. Specifically, the traffic events may include any traffic events located within the geographic region containing the selected route as well as any adjacent road segments located within the geographic region that are affected by the traffic event. The traffic event may also include any affected road segments located within the area of interest that are affected by a traffic event that is located outside the area of interest.

The processor 12, in step 116, calculates the distance from each traffic event in the geographic region containing the selected route to each stored location from step 104. In step 118, processor 12 retrieves a predetermined threshold distance which had been stored in storage unit 38 during the manufacturing process.

As shown in step 120, processor 12 compares the calculated distances from step 116 to the threshold distance in step 118. If any of the calculated distances from step 116 are equal to or less than the threshold distance in step 118, the method 100 proceeds to step 121. If no traffic events are found, the method returns to step 114.

In step 121, the processor 12 determines a priority level of the traffic event. The priority level of the traffic event is compared to a user-selected priority level, as shown in step 123. If the traffic event priority level is below the user-selected priority level, the method 100 returns to step 114. Otherwise, the system 10 determines if the same traffic event was reported in a prior cycle of the method 100, as shown in step 122.

In step 122, a determination is made if the same traffic event was reported before. If the same traffic event was not reported before, the user is alerted as indicated in step 124. Otherwise, the system 10 determines if the user should be alerted again, as shown in step 126. This determination is similar to step 66 in FIG. 2. After step 124 and/or 126 have been executed, the system proceeds to previously described step 114.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A method for providing a user with traffic information, the method comprising the steps of:

determining at least one area of interest including a plurality of latitudinal and longitudinal coordinates;

receiving traffic data including information related to a plurality of traffic events;

parsing the traffic data for any of the traffic events located within the at least one area of interest; and outputting a traffic event message to an output device if a latitudinal and longitudinal location of the related traffic event is located within the at least one area of interest.

2. The method according to claim 1, wherein each of the traffic events includes at least one of a traffic incident located within the area of interest, a plurality of adjacent road segments located within the area of interest that are affected by the traffic incident, and any affected road segments located within the area of interest that are affected by a traffic incident that is located outside the area of interest.

3. The method according to claim 1, further comprising the steps of:

converting the traffic data to an audio traffic event message; and outputting the audio traffic event message to the output device.

4. The method according to claim 1, wherein the step of determining at least one area of interest further comprises the steps of:

receiving a set of location readings taken at periodic intervals;

determining a travel direction by comparing latitudinal and longitudinal changes among the set of readings first; and defining the at least one area of interest as a plurality of latitudinal and longitudinal coordinates surrounding the travel direction.

5. The method according to claim 1, wherein the step of determining at least one area of interest further comprises the steps of:

receiving a plurality of locations of the user;

determining a travel route by comparing the plurality of locations of the user; and defining the at least one area of interest as a plurality of latitudinal and longitudinal coordinates surrounding the travel route.

6. The method according to claim 1, further comprising the steps of:

determining if the traffic event message has been previously outputted to the output device; and outputting the traffic event message to the output device if the traffic event has not been previously outputted to the output device.

7. The method according to claim 1, wherein the traffic data is received from a RDS-TMC signal coded in accordance with the Alert-C protocol.

8. The method according to claim 1, wherein the traffic data includes at least one of an event description, a location, a direction and extent, a duration, and a diversion advice.

9. The method according to claim 1, further comprising the steps of:

determining a priority level of each of the traffic events within the at least one area of interest;

comparing the priority level of each of the traffic events within the at least one area of interest with a user-selected priority level; and filtering the traffic events to remove any traffic event that does not meet the user-selected priority level.

10. A method for providing a user with traffic information, the method comprising the steps of:

determining at least one area of interest including a plurality of latitudinal and longitudinal coordinates;

receiving a traffic data including information related to a plurality of traffic events;

parsing the traffic data for any of the traffic events located within the at least one area of interest;

determining a priority level of each of the traffic events within the at least one area of interest;

comparing the priority level of each of the traffic events within the at least one area of interest with a user-selected priority level;

filtering the traffic events to remove any traffic event that does not meet the user-selected priority level; and outputting a traffic event message to an output device if a latitudinal and longitudinal location of the related traffic event is located within the at least one area of interest.

11. The method of claim 10, further comprising the steps of:

converting the traffic message to an audio traffic event alert; and outputting the audio traffic event message to the output device.

12. The method of claim 10, wherein the step of determining at least one area of interest further comprises the steps of:

receiving a set of location readings taken at periodic intervals;

determining a travel direction by comparing latitudinal and longitudinal changes among the set of readings first; and defining the at least one area of interest as a plurality of latitudinal and longitudinal coordinates surrounding the travel direction.

13. The method of claim 10, wherein the step of determining at least one area of interest further comprises the steps of:

receiving a plurality of locations of the user;

determining a travel route by comparing the locations of the user; and defining the at least one area of interest as a plurality of latitudinal and longitudinal coordinates surrounding the travel route.

14. The method of claim 10, further comprising the steps of:

determining if the traffic message has been previously outputted to the output device; and outputting the traffic message to the output device if the traffic event has not been previously outputted to the output device.

15. The method according to claim 10, wherein the traffic data is received from a RDS-TMC signal coded in accordance with the Alert-C protocol.

16. The method according to claim 10, wherein the traffic data includes at least one of an event description, a location, a direction and extent, a duration, and a diversion advice.

17. The method according to claim 10, wherein each of the traffic events includes at least one of a traffic incident located within the at least one area of interest, a plurality of adjacent road segments located within the at least one area of interest that are affected by the traffic incident, and any affected road segments located within the at least one area of interest that are affected by a traffic incident that is located outside the at least one area of interest.

18. In a non-transitory computer readable storage medium having stored therein data representing instructions executable by a programmed processor for enabling operation of a system for providing a user with traffic information, the storage medium comprising instructions for:

determining at least one area of interest including a plurality of latitudinal and longitudinal coordinates;

receiving a traffic data including information related to a plurality of traffic events;

parsing the traffic data for any of the traffic events located within the at least one area of interest;

determining a priority level of each of the traffic events within the at least one area of interest;

comparing the priority level of each of the traffic events within the at least one area of interest with a user-selected priority level;

filtering the traffic events to remove any traffic event that does not meet the user-selected priority level; and outputting a traffic event message to an output device if a latitudinal and longitudinal location of the related traffic event is located within the at least one area of interest.

19. The instructions of claim 18, wherein the instruction for determining at least one area of interest further comprises instructions for:

receiving a set of location readings taken at periodic intervals;

determining a travel direction by comparing latitudinal and longitudinal changes among the set of readings; and defining the at least one area of interest as a plurality of latitudinal and longitudinal coordinates surrounding the travel direction.

20. The instructions of claim 18, wherein the instruction for determining at least one area of interest further comprises instructions for:

receiving a plurality of locations of the user;

determining a travel route by comparing the locations of the user; and defining at least one area of interest as a plurality of latitudinal and longitudinal coordinates surrounding the travel route.

* * * * *